US011118400B1

(12) United States Patent
Davis

(10) Patent No.: US 11,118,400 B1
(45) Date of Patent: Sep. 14, 2021

(54) METHOD OF USING A CARRYING DEVICE

(71) Applicant: Jarran C. Davis, Tulsa, OK (US)

(72) Inventor: Jarran C. Davis, Tulsa, OK (US)

( * ) Notice: Subject to any disclaimer, the term of this patent is extended or adjusted under 35 U.S.C. 154(b) by 13 days.

(21) Appl. No.: 16/666,721

(22) Filed: Oct. 29, 2019

Related U.S. Application Data

(63) Continuation-in-part of application No. 16/512,100, filed on Jul. 15, 2019, now abandoned, which is a continuation-in-part of application No. 29/607,030, filed on Jun. 9, 2017, now Pat. No. Des. 869,687.

(51) Int. Cl.
*E06C 7/14* (2006.01)

(52) U.S. Cl.
CPC ..... *E06C 7/14* (2013.01)

(58) Field of Classification Search
CPC ..... E06C 7/14; B44D 3/14; B65D 25/32
See application file for complete search history.

(56) References Cited

U.S. PATENT DOCUMENTS 1,137,909 A * 5/1915 Rusefeldt ..... A47J 45/10 294/33
2,684,797 A * 7/1954 Schulte ..... B65D 33/12 294/165
3,262,727 A * 7/1966 Blackaby ..... A45F 5/102 294/170
3,679,103 A * 7/1972 Chmela ..... B65D 25/32 222/192
3,680,752 A * 8/1972 Wilson ..... A45F 5/1046 294/171
5,836,634 A * 11/1998 Finkelman ..... A45F 5/1026 294/159
9,539,851 B1 * 1/2017 Tanda ..... B44D 3/14

* cited by examiner

*Primary Examiner* — Amy J. Sterling
(74) *Attorney, Agent, or Firm* — Chad Hinrichs

(57) ABSTRACT

A method for using a carrying device to hang a can from a ladder and carrying a plurality of cans. The carrying device having a body with a handle connection a first and second member extending from the handle. The first and second members are located at opposing ends of the handle. The first member has a hook on the end opposite the handle. The second member has a first and second hook on the end opposite the handle. The first and second hook are located on opposing sides of the second member. The device can be used to carry multiple gallon cans of paint, five gallon pails as well as sheet material such as plywood and sheetrock.

3 Claims, 15 Drawing Sheets

METHOD OF USING A CARRYING DEVICE

PRIORITY CLAIM

The present application claims priority to and is a continuation in part of U.S. Non-Provisional patent application Ser. No. 16/512,100 filed on Jul. 15, 2019 which was a continuation in part of U.S. Design patent application Ser. No. 29/607,030 filed on Jun. 9, 2017. These parent applications are incorporated herein by reference.

FIELD OF THE INVENTION

The present invention relates generally to a device for carrying a ladder and other items. More particularly, the present invention relates to the device and methods for using the device.

BACKGROUND OF THE INVENTION

Ladders are heavy and awkward to carry. Further using a ladder is often part of painting, drywall repair and other carpentry tasks. These tasks often include carrying paint and other liquids in one gallon cans with wire handles or in five gallon buckets with wire handles. The wait of these cans and buckets baring down on the user's hands through the wire handles is quite uncomfortable. Similarly, these tasks often entail using pieces of sheet material such as plywood and drywall which come in 4 foot by 8 foot sheets. These sheets are cumbersome and heavy to carry. Here too the weight of the sheets of material can be painful to carry. What is needed, therefore, is a device and method to carefully carry these items.

BRIEF SUMMARY OF THE INVENTION

The present invention is a removeable handle and method for using the device. The device can be used in a number of ways. It can be used to carry a ladder in both an upright and horizontal manner. It can also be used to carry multiple one gallon cans of liquids, a five gallon bucket of liquid and one or more sheets of material such as plywood or sheetrock.

The present invention can be utilized in other ways. This includes to hang a paint can or other container with a wire handle from the leg of a ladder. It can also hold a drill or other power tool on the leg of a ladder

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENTS

Figure 1:
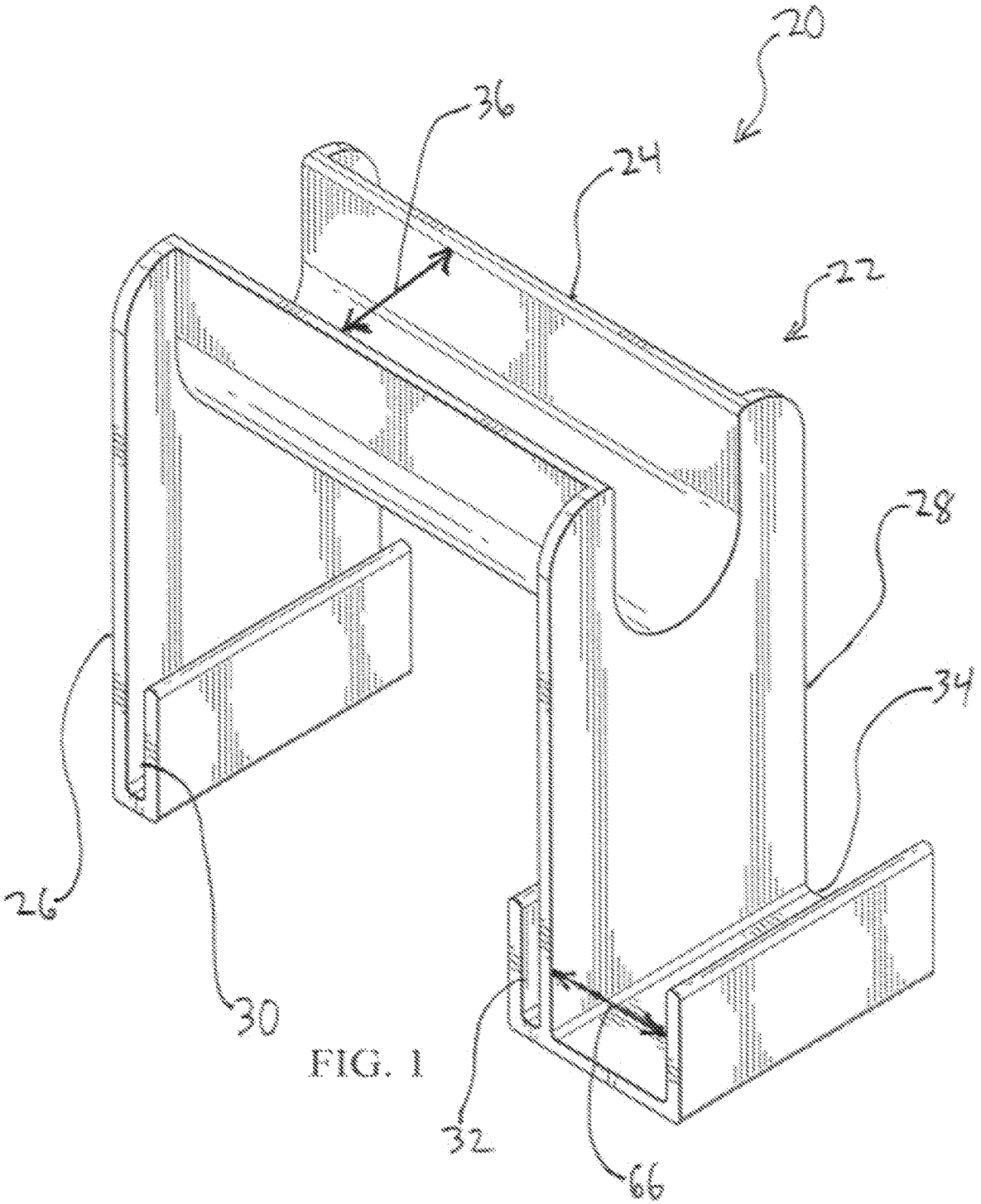
FIG. 1 is a front perspective view illustrating the device for carrying a ladder.
Figure 2:
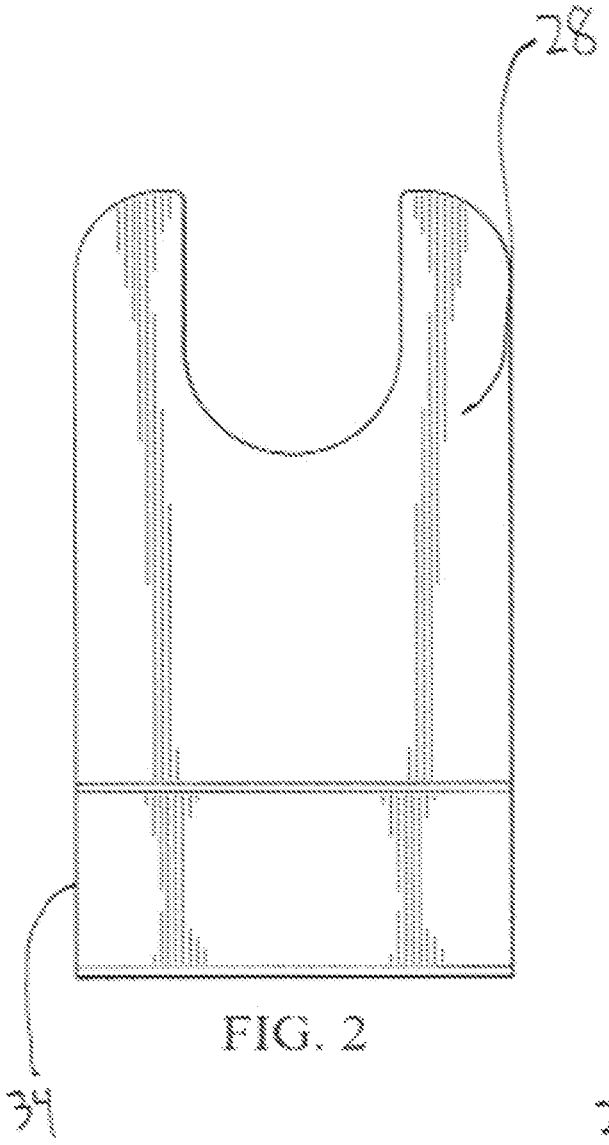
FIG. 2 is a front elevational view of the device for carrying a ladder.
Figure 3:
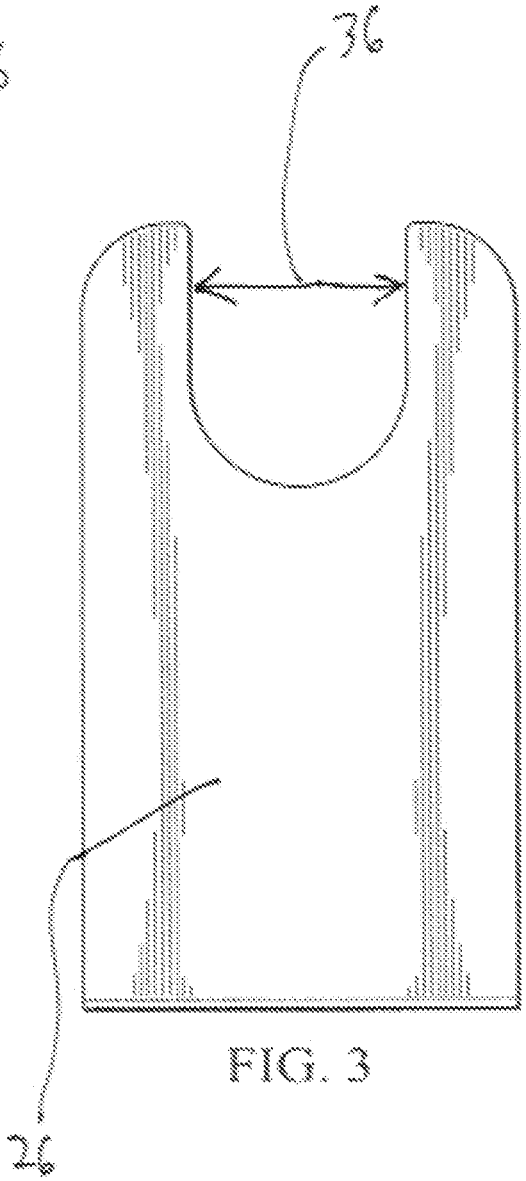
FIG. 3 is a rear elevational view the device for carrying a ladder.
Figure 4:
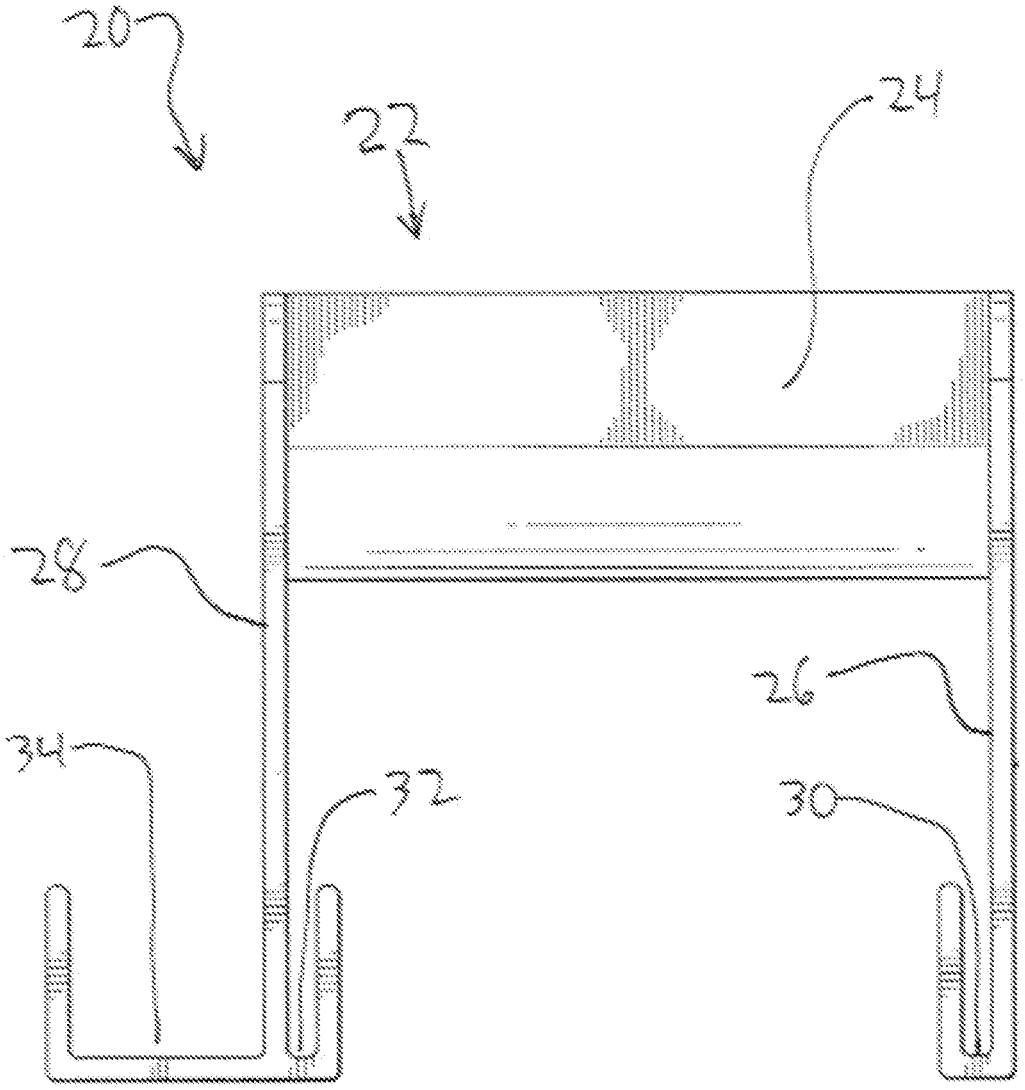
FIG. 4 is a right side elevational view of the device for carrying a ladder.
Figure 5:
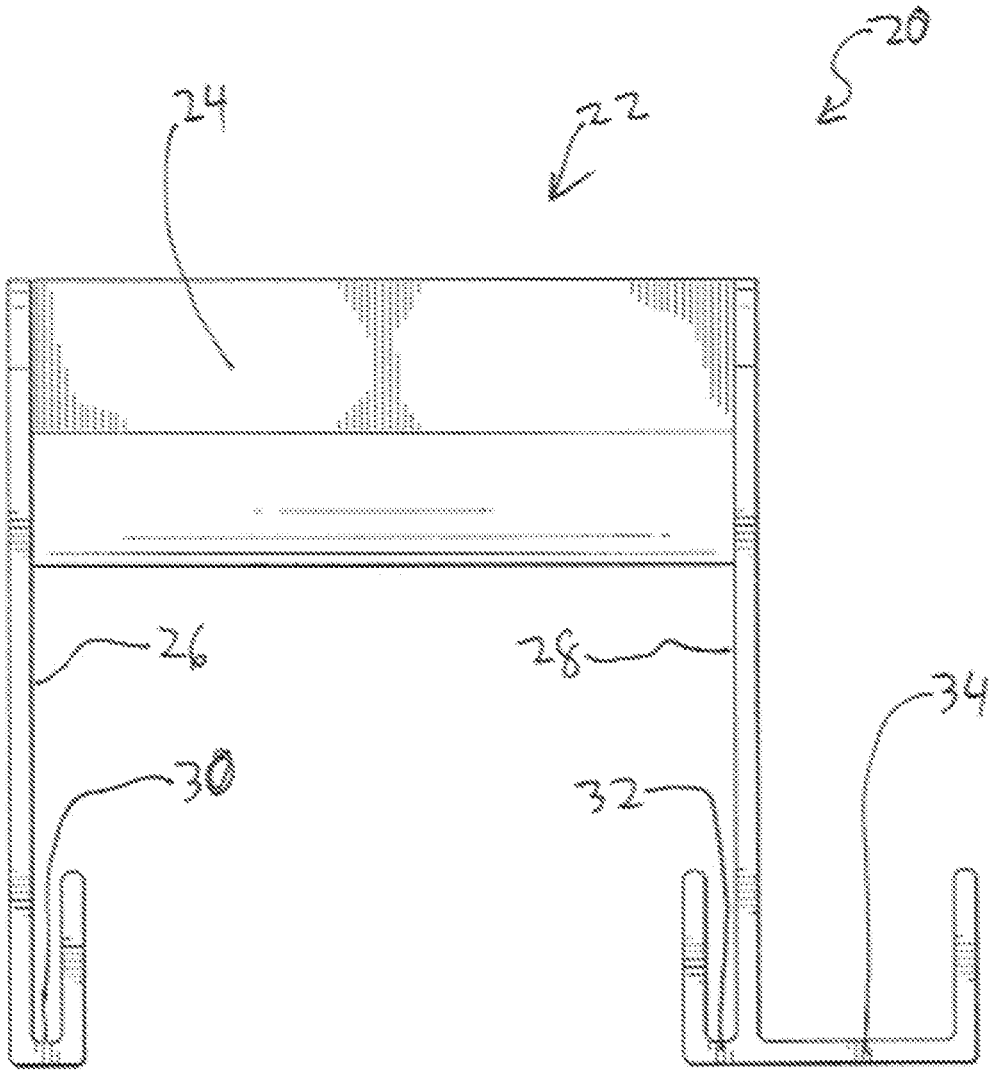
FIG. 5 is a left side elevational view of the device for carrying a ladder.
Figure 6:
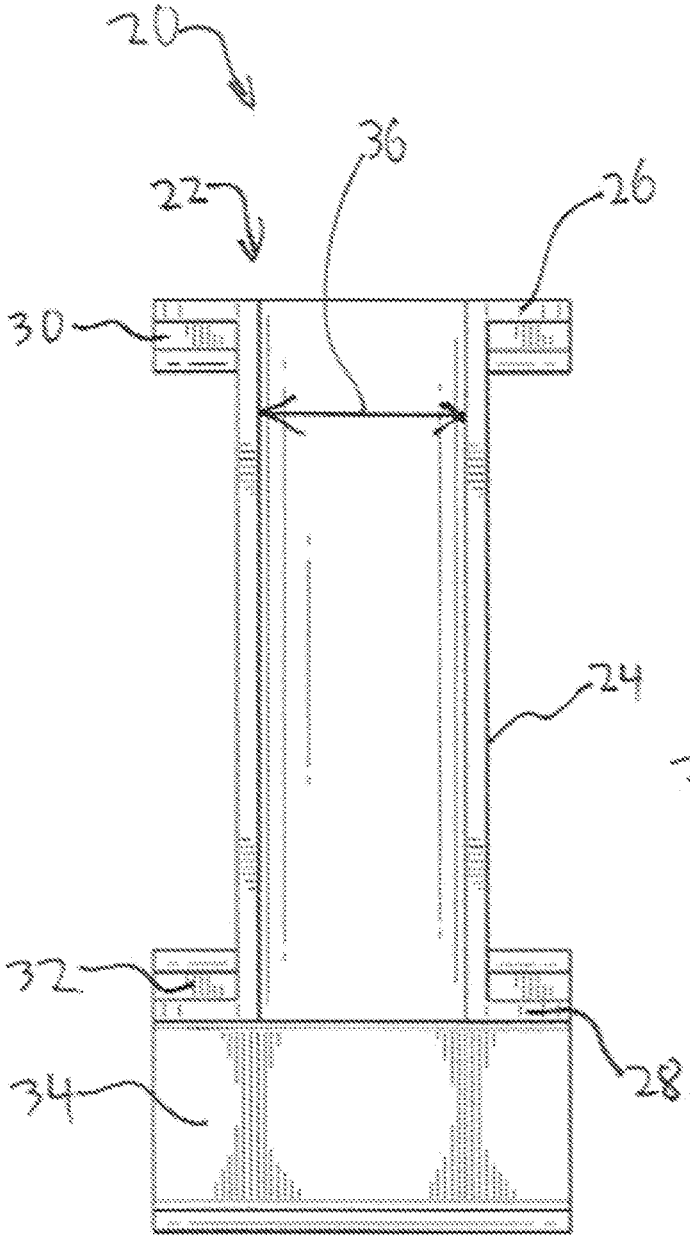
FIG. 6 is a top view of the device for carrying a ladder.
Figure 7:
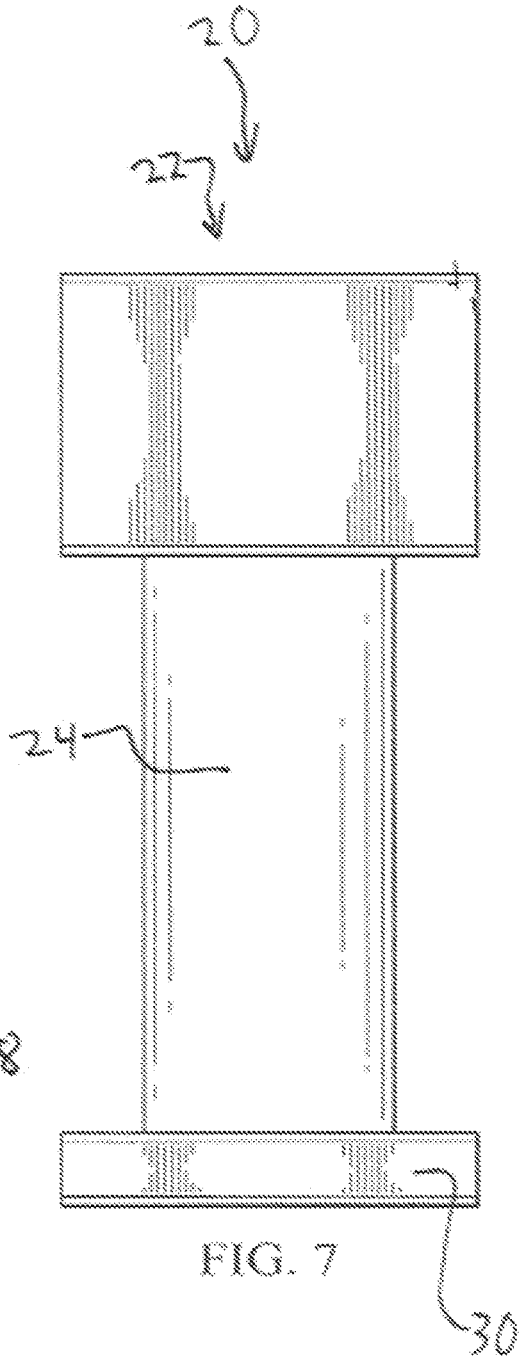
FIG. 7 is a bottom view of the device for carrying a ladder.

Turning now to the drawings wherein like reference characters indicate like or similar parts throughout, FIGS. 1-7 illustrates the preferred embodiment of the present invention, a device 20 for carrying a ladder or other items. The device 20 has a body 22 with a handle 24 connecting a first and second member 26 and 28 which extend from the handle 24. In the preferred embodiment members 26 and 28 are parallel with one another and extend from the handle 24 in the same direction. The first and second members 26 and 28 are located at opposing ends of the handle 24. The first member 26 has a hook 30 on the end opposite the handle 24. The second member 28 has a first and second hook 32 and 34 on the end opposite the handle 24. The first and second hook 32 and 34 are located on opposing sides of the second member 28. In the preferred embodiment the hook 30 on the first member 26 is on the side of the first member 26 closest to the second member 28. Likewise, the first hook 32 on the second member 28 is on the side of the second member 28 which is closest to the first member 26.

In the preferred embodiment, the handle 24 is hollow. It is further preferred that the handle 24 is U-shaped with the opening or top of the U oriented in the opposite direction as the first and second member 26 and 28.

Figure 8A:
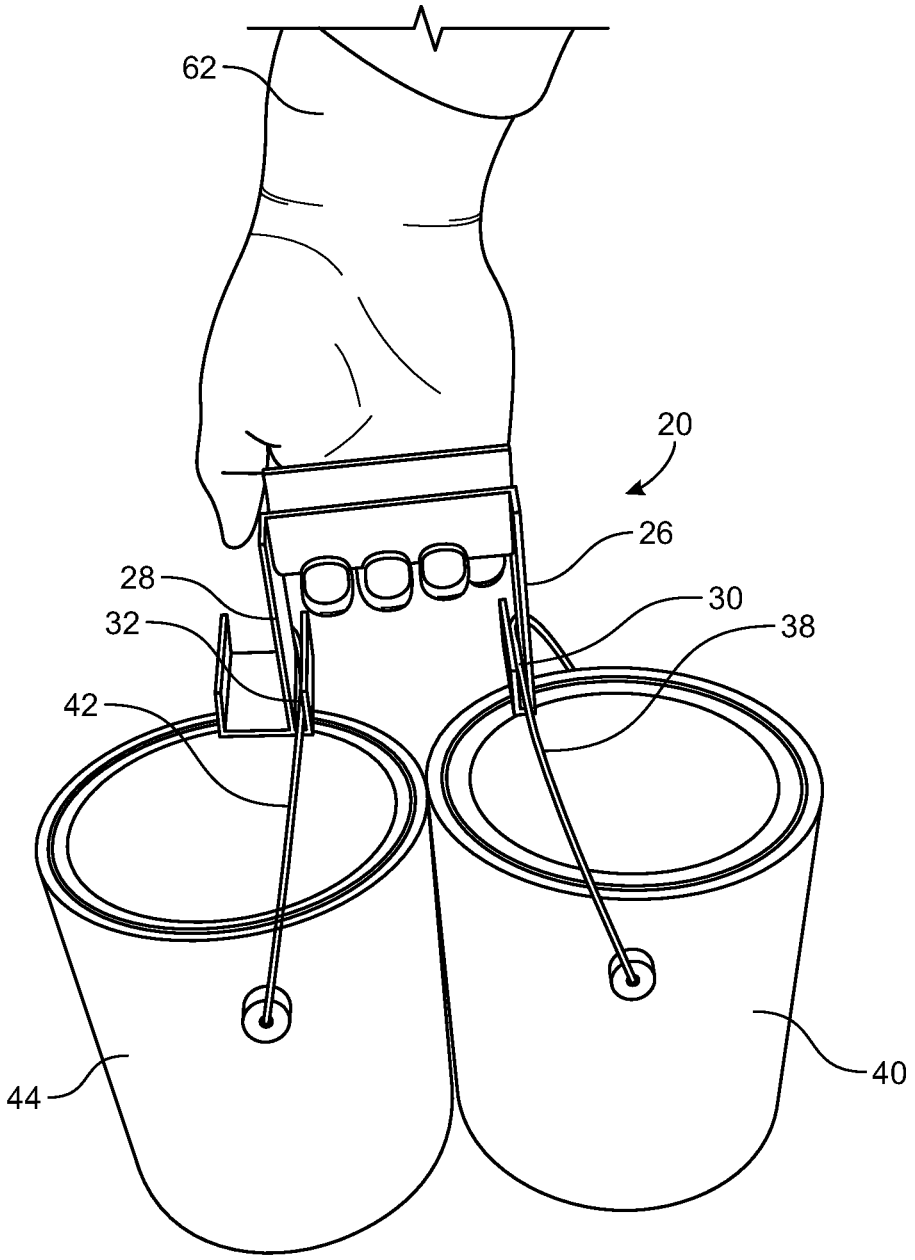
FIG. 8A is a side view of a method for carrying two one-gallon cans.
Figure 8B:
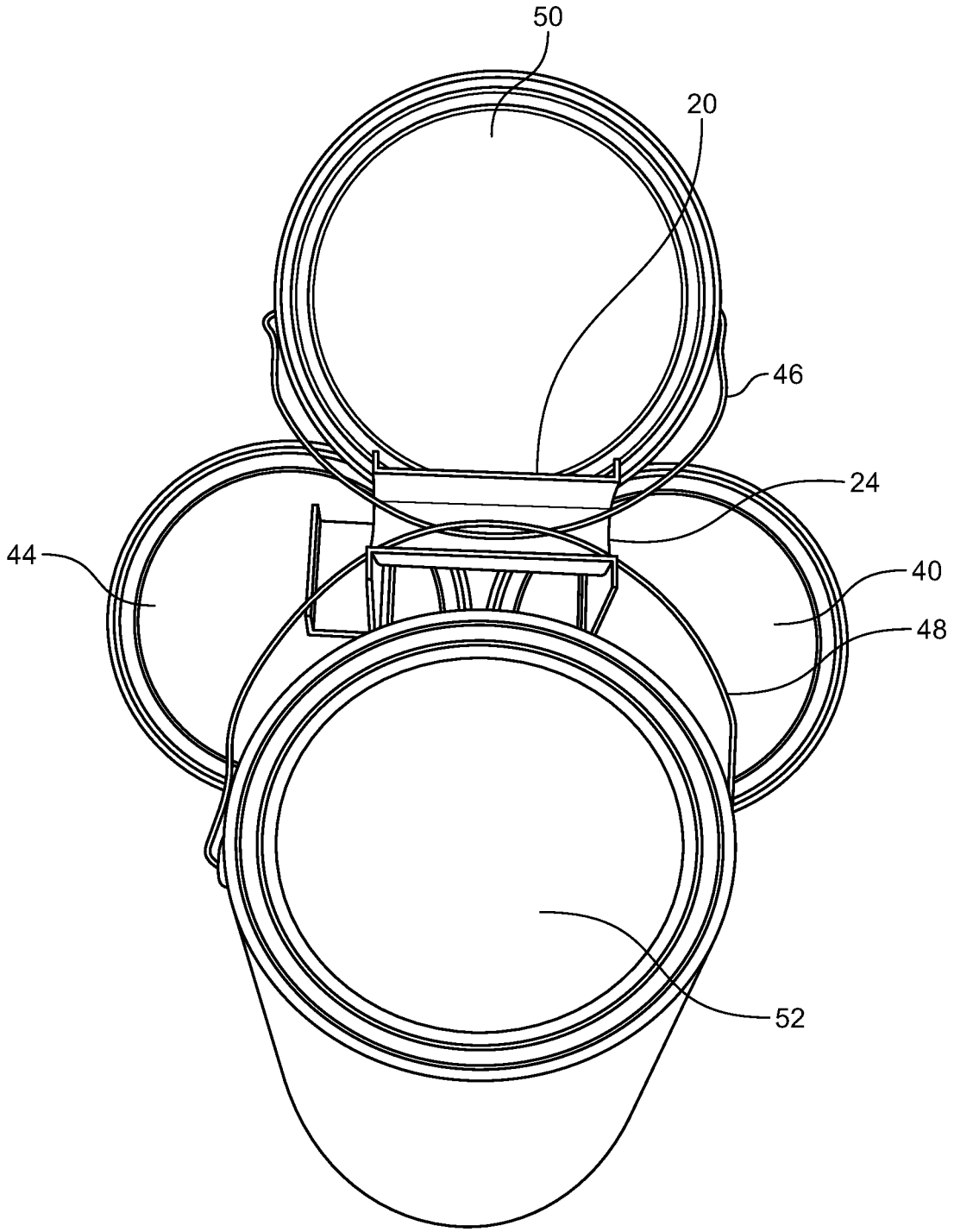
FIG. 8B is a top view of a method for carrying four one-gallon cans.

The carrying device 20 can also be used for other tasks such as to carry up to four one-gallon cans with wire handles. It should be noted the material of the wire handle could be steel, aluminum, plastic or other material with a high tension strength. Likewise, the exact volume of the can may vary. See FIGS. 8A and 8B. This method of carrying multiple one-gallon cans is accomplished by hooking the wire handle 38 of a first can 40 over both the hook 30 on the first member 26 and the wire handle 42 of a second one-gallon can 44 over the first hook 32 of the second member 28. The wire handle 46 and 48 of a third and fourth one-gallon cans 50 and 52 are hooked over the hollow handle 24 with the third and fourth cans 50 and 52 being located on opposing sides of the handle 24. The user can then lift all of the cans by grasping and lifting the handle 24.

The carrying device 20 can be used carry one to three cans by hanging them from their respective wire handles from the hooks 30 and 32 and/or handle 24. In this mode of use it is helpful but not necessary to balance the load on the device 20 from end to end and/or side to side. Thus, if carrying two cans they may be hung from the hooks 30 and 32 or from the handle 24 with a can located on either side of the handle.

Figure 9:
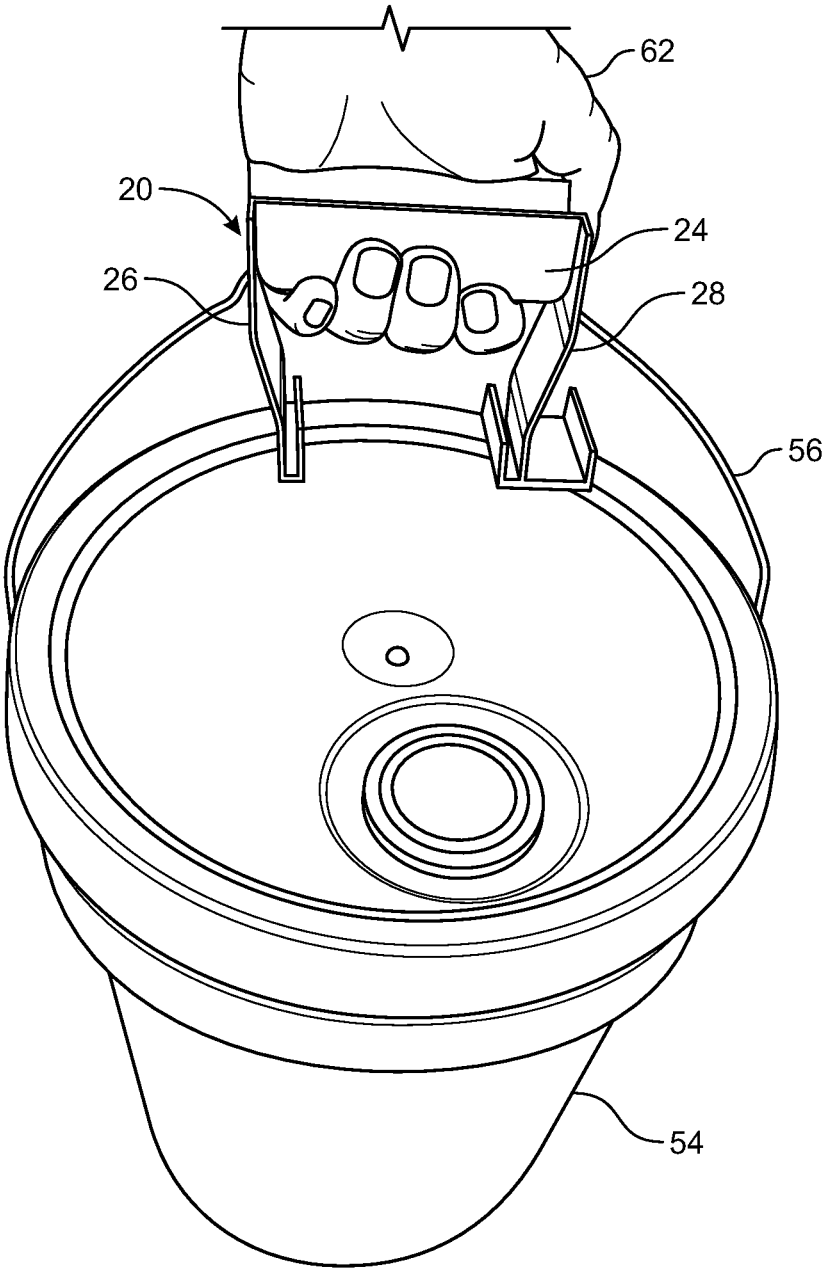
FIG. 9 is a perspective view of a method for using the carrying device to carry a five gallon bucket.

The carrying device 20 can be used to ease carrying heavy loads as well, such as a 5-gallon bucket of paint or other liquids 54. See FIG. 9. This method is accomplished by passing the wire handle 56 of the bucket 54 through the hollow center of the handle 24. This allows the weight of the bucket 54 to be spread across the outer surface of the handle 24 which contacts the user's hand. This results in lower pressure on the user's hand. As with the one-gallon cans, it should be noted the material of the wire handle could be steel, aluminum, plastic or other material with a high tension strength. Likewise, the exact volume of the bucket may vary.

Figure 10:
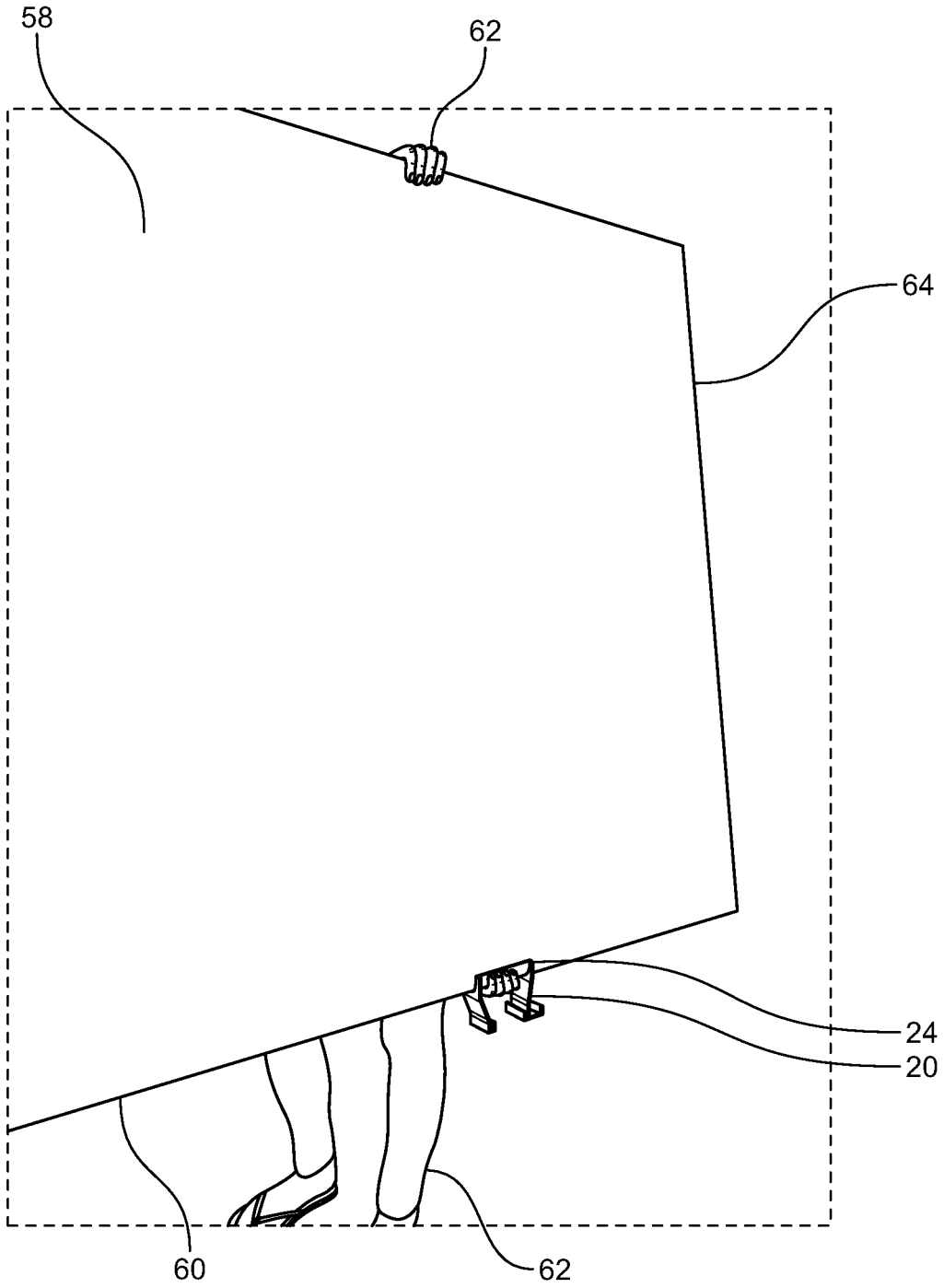
FIG. 10 is a perspective view of a method for using the carrying device to carry sheet material such as plywood or sheetrock.

The carrying device 20 can also be used to carry large sheet materials 58 such as plywood and sheetrock. See FIG. 10. In this method the long edge 60 of the sheet material 58 is placed inside the handle 24 of the device 20. With the sheet material 58 in a generally vertical plane, the user 62 can then grasp the handle 24 and lift up while steadying or balancing the sheet material 58 with the user's second hand. This allows the weight of the sheet material 58 to be spread across a larger area in the user's 62 hand, i.e. the outer surface of the handle 24. Multiple pieces of sheet material 58 can be simultaneously carried by this method so long as the total thickness 64 of the sheet material 58 is less than the inside width 36 of the handle 24.

Figure 11:
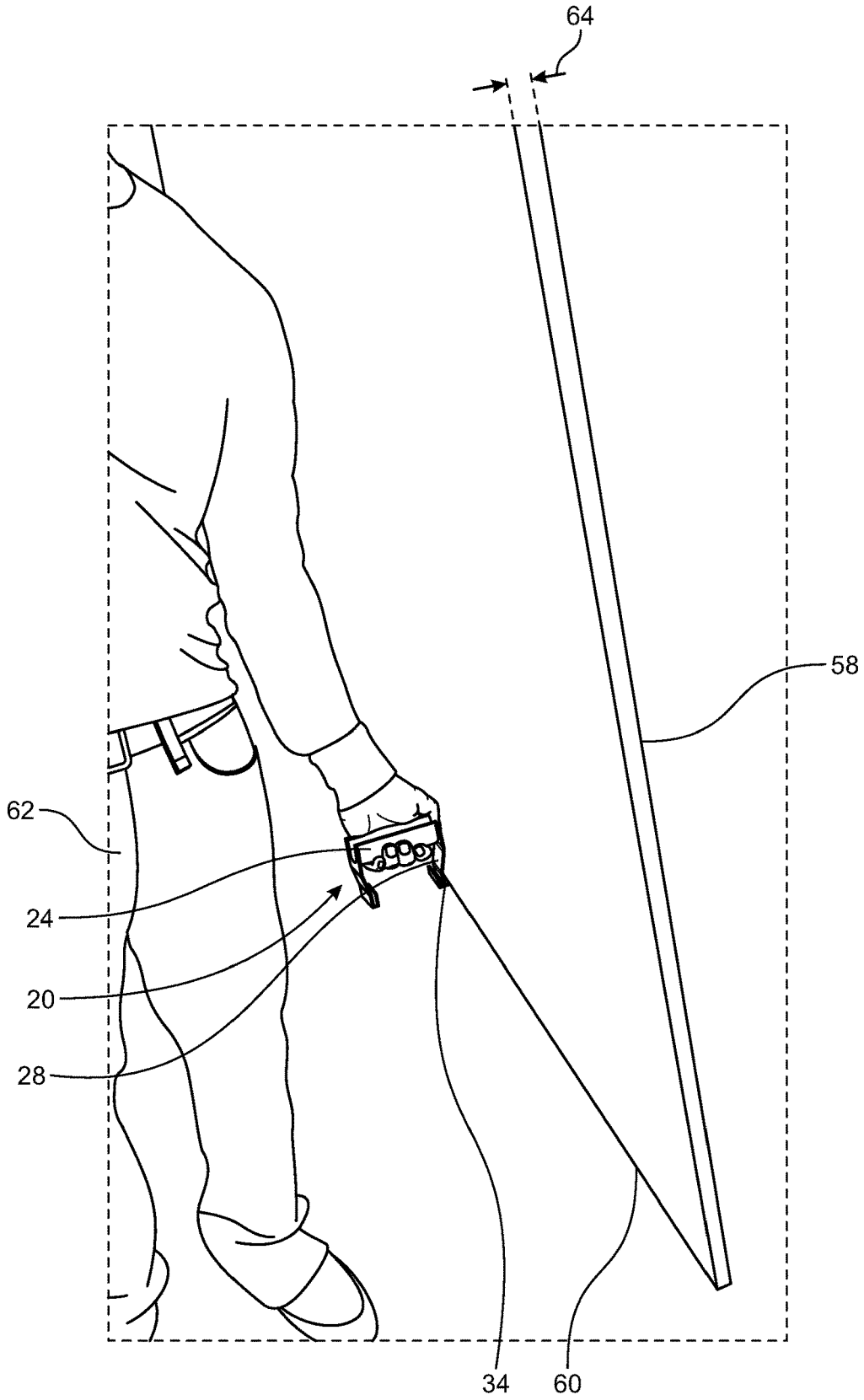
FIG. 11 is a perspective of a second method for using the carrying device to carry sheet material such as plywood or sheetrock.

Sheet material 58 can also be carried in a similar manner with the carrying device 20 by placing the long edge 60 of the sheet material 58 in the second hook 34 of the second member 28. See FIG. 11. Here again multiple pieces of sheet material 58 can be simultaneously carried by this method so long as the total thickness 64 of the sheet material 58 is less than the inside width 66 of the second hook 34.

Figure 12:
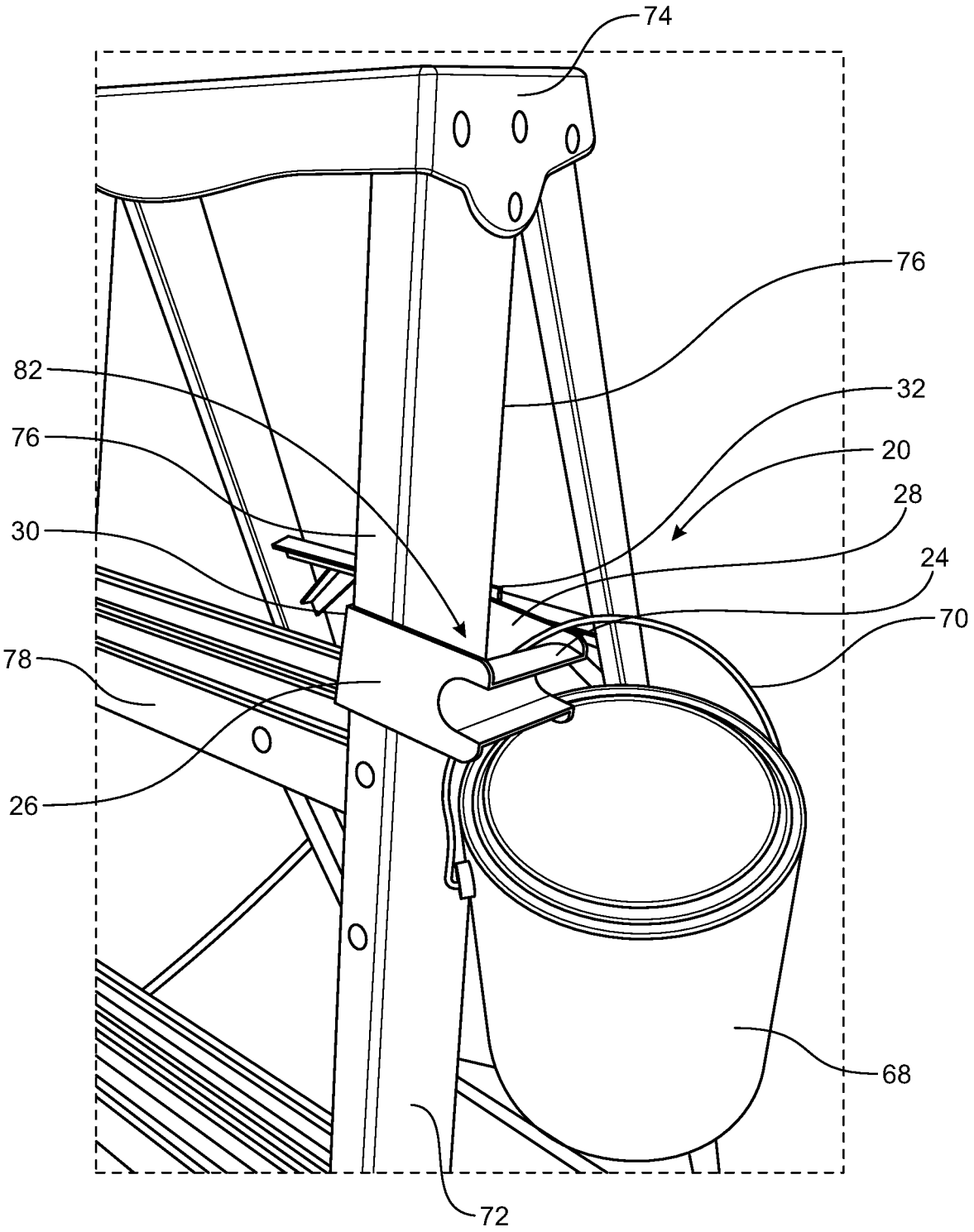
FIG. 12 is a perspective view of a method for using the carrying device to hang a can from a ladder leg.

Further, the carrying device 20 can be used to hang a can 68 with a wire handle 70 (such as a paint can, pail or the like) on the leg 72 of a ladder 74. See FIG. 12. For this method, the wire handle 70 of the can 68 is placed between the first member 26, the second members 28, the handle 24 and the leg 72 of a ladder 74. The hook 30 on the first member 26 and the first hook 32 on the second member 28 are attached to opposing sides 76 of the leg 72 of the ladder 74 just above a step 78. The user then lowers the can 68 until its weight pulls down on the wire handle 70 and the handle 24 of the carrying device 20. This causes the carrying device 20 to rotate downward which in turn causes the hooks 30 and 32 to hook onto the opposing sides 76 of the leg 72 of the ladder 74 and on top of a step 78. This also moves the can 68 against the leg 72 of the ladder 74.

Figure 13:
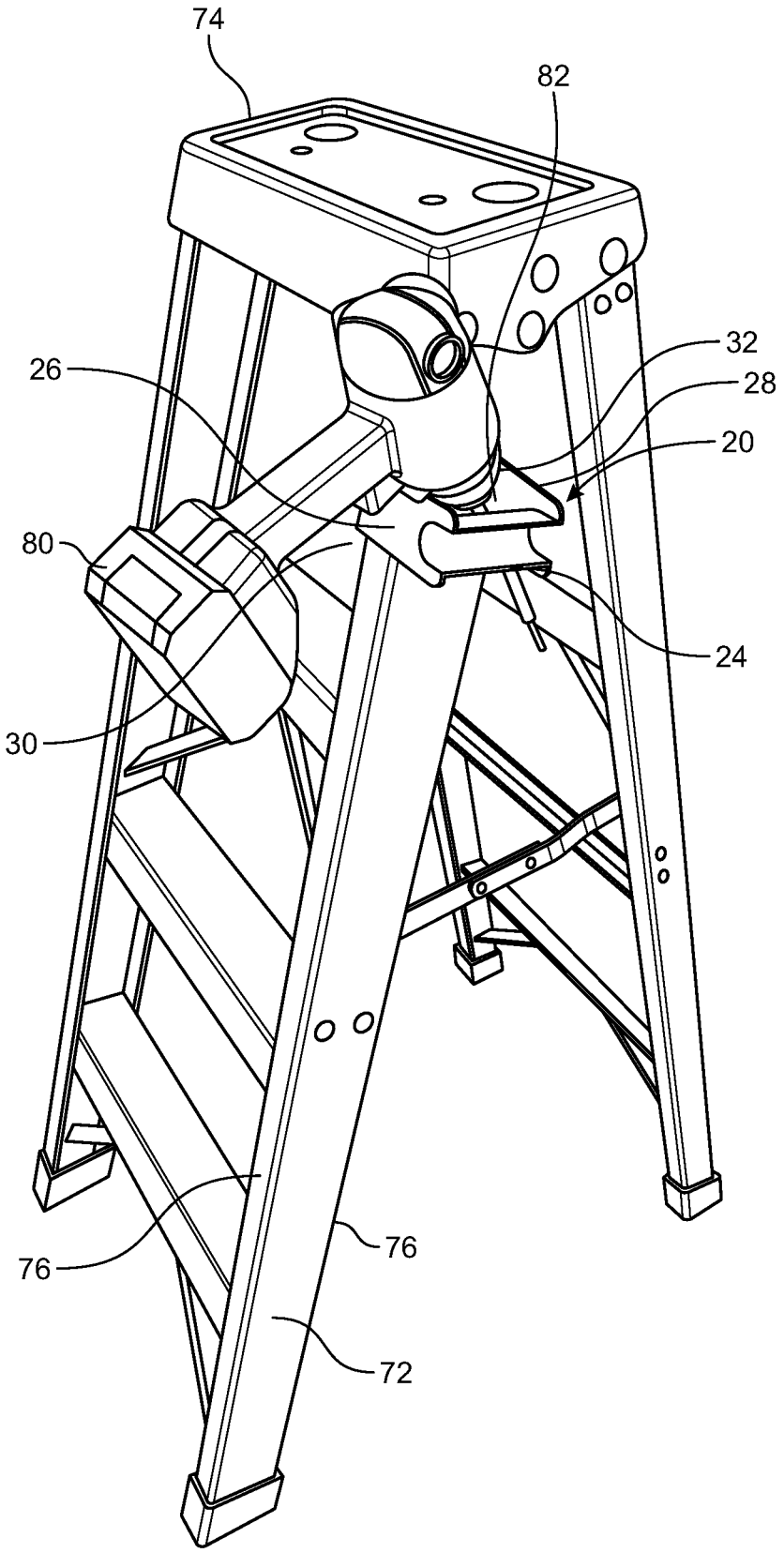
FIG. 13 is a perspective view of a method for using the carrying device to hang a power tool from a ladder leg.

The carrying device 20 can also be used in a similar manner to hold a power tool 80. See FIG. 13. This could include but is not limited to drills, impact drivers and other useful power tools. In this method the carrying device 20 is mounted on the leg 72 of a ladder 74, such that the hooks 30 and 32 are hooked onto the opposing sides 76 of the leg 72 of the ladder 74 and on top of a step 78. The carrying device 20 is rotated downward slightly to lock onto the leg 72. The power tool 80 can then be placed into the passageway 82 between the handle 24, first member 26, second member 28 of the carrying device 20 and the leg 72 of the ladder 74.

Figure 14:
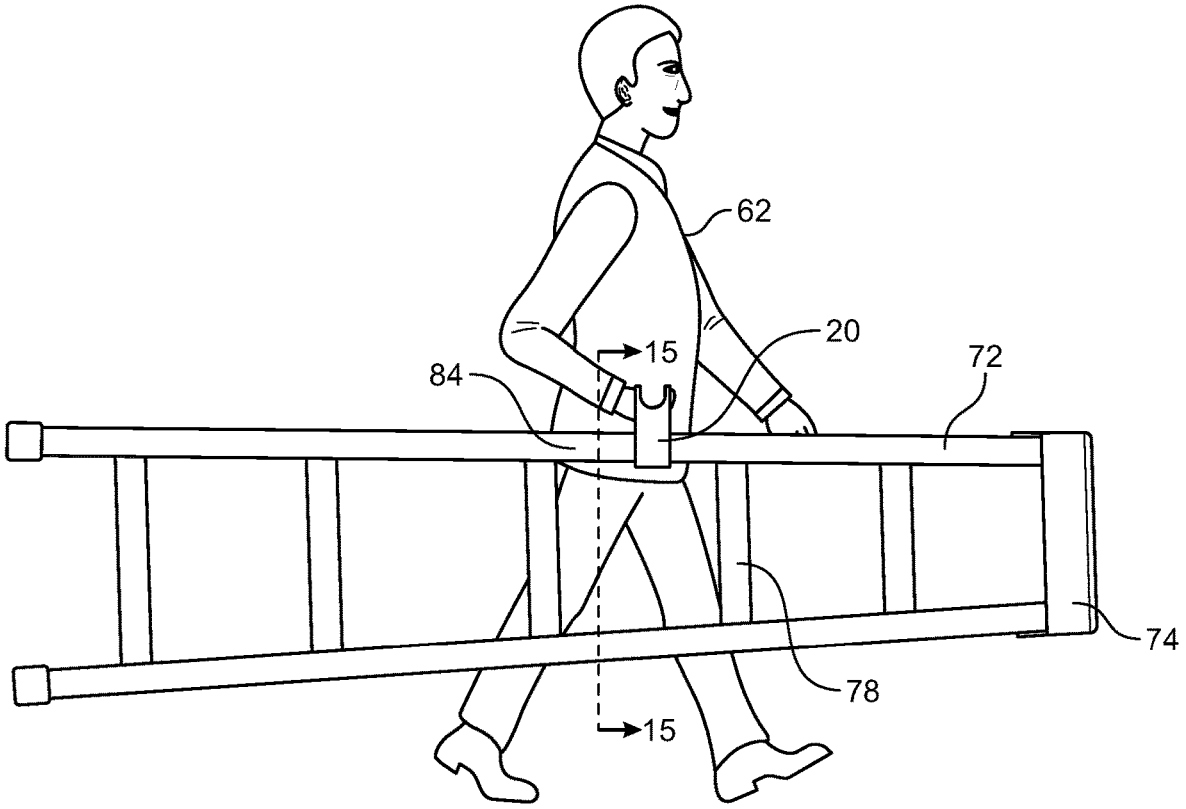
FIG. 14 is a perspective view of the carrying device used to carry a ladder in a horizontal orientation.
Figure 15:
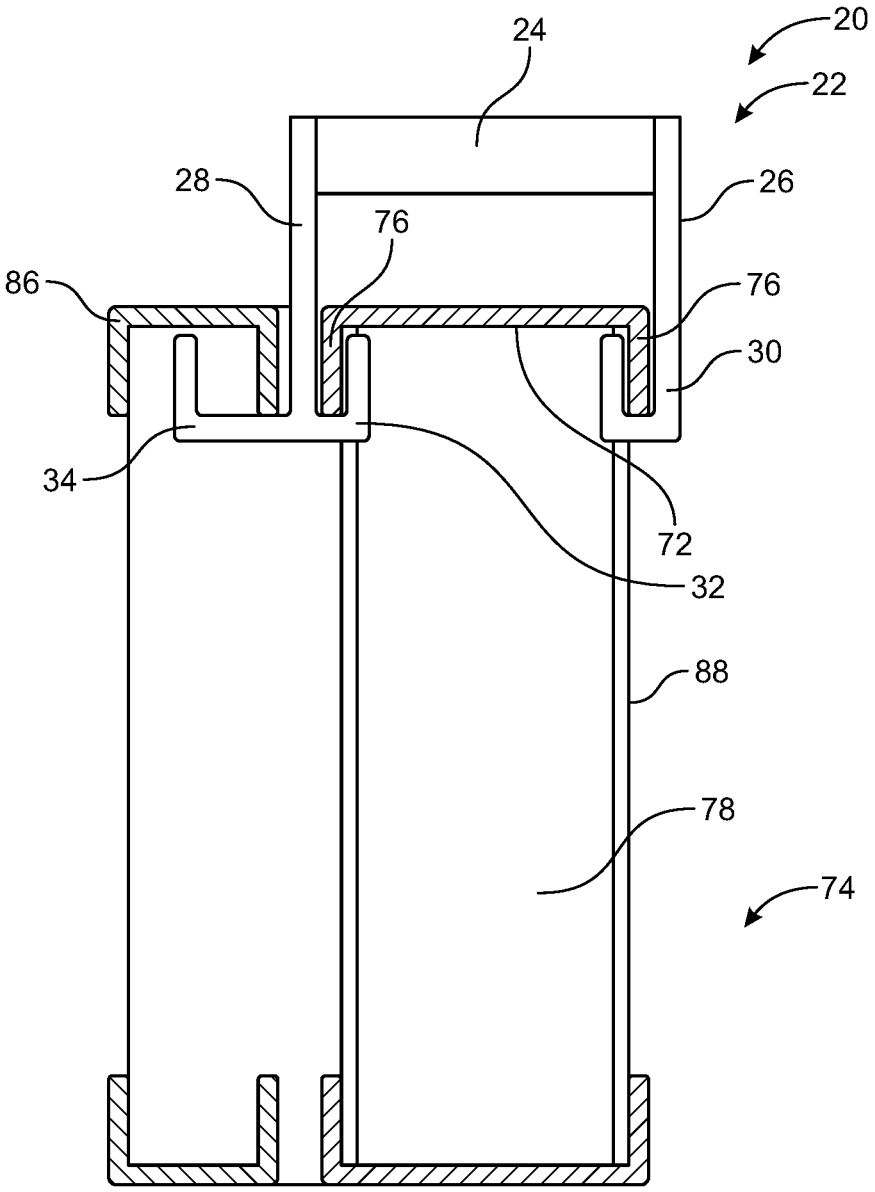
FIG. 15 is a cross-sectional view of the carrying device attached to a ladder.

The carrying device 20 can be used to carry a ladder 74 in a horizontal or vertical orientation. FIG. 14 illustrates the carrying device 20 used to carry a ladder 74 in a horizontal orientation. The device is attached to the leg 72 of the ladder 74 at approximately the midpoint 84. The hook 30 on the first member 26 and the first hook 32 on the second member 28 are attached to opposing sides 76 of the leg 72 of the ladder 74. Once the carrying device 20 is mounted on the leg 72, a second leg 86 of the ladder 74 is moved next to the leg 72, thus placing the ladder 74 in a closed position. As the second leg 86 is moved into the closed position, the second hook 34 on the second member 28 is hooked onto the second leg 86.

Once the carrying device 20 is mounted on the ladder 74 as described above, the ladder 74 can be moved into a horizontal orientation (if it is not already in that orientation) and lifted by a user 62 lifting up on the carrying device 20 with their first hand. The user 62 may use a second hand to steady and guide the ladder 74.

Figure 16:
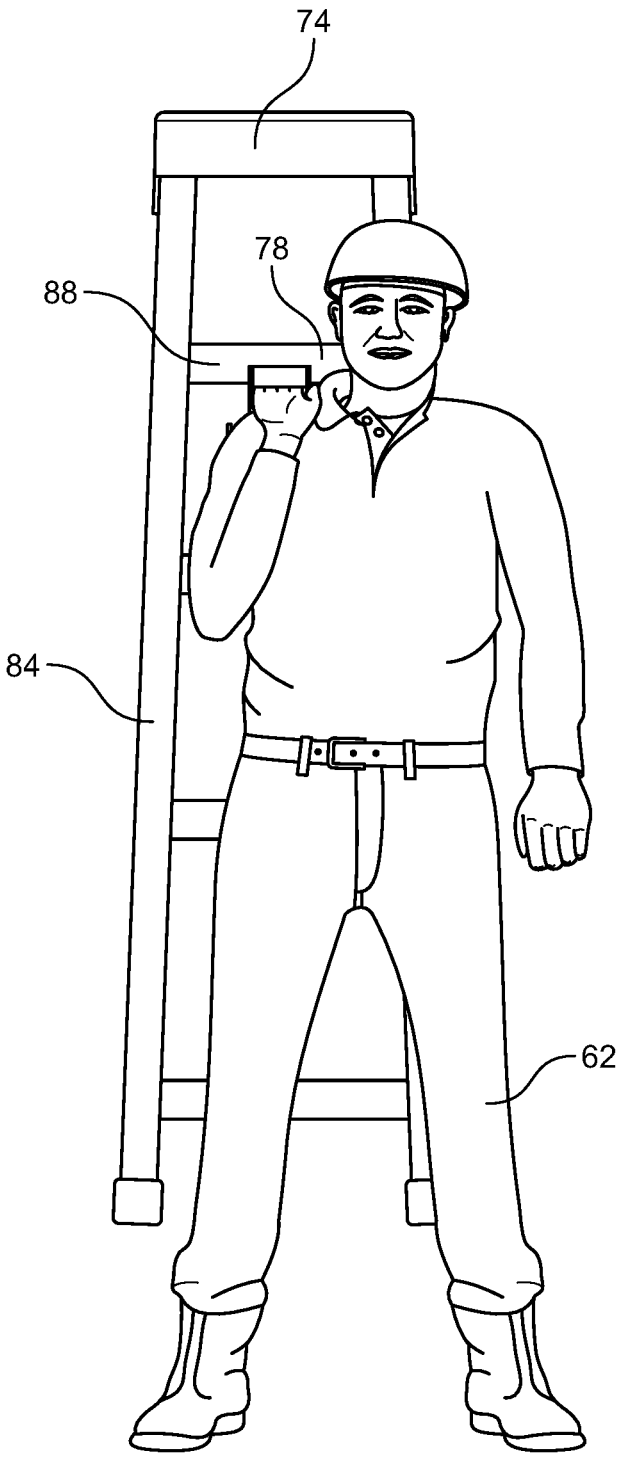
FIG. 16 is a perspective view of the carrying device used to carry a ladder in a vertical orientation.

The carrying device 20 can also be used to carry a ladder 74 in a vertical orientation such as shown in FIG. 16. With the ladder 74 in the closed position and vertical orientation, the user 62 grabs the handle 24, inserts the front lip 88 of a step 78 into the hollow interior of the handle 24 and lifts upwards on the handle 24 and ladder 74. In the preferred embodiment the step 78 used to lift the ladder 74 is located above the midpoint 84 of the ladder 74. Further, it may be helpful for the user 62 to hold the handle 24 just above the shoulder of the hand holding the handle 24 with the ladder 74 extending down the back of the user 62.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A method for carrying a plurality of cans, the method comprising:

providing a plurality of cans each having a wire handle;

providing a carrying device having a body with a handle connecting a first and second member extending from the handle, the first and second members located at opposing ends of the handle, a hook located on an end of the first member opposite the handle; a first and second hook on the second member on an end opposite the handle, the first and second hook located on opposing sides of the second member;

placing the wire handle of a first can in the hook on the first member;

placing the wire handle of a second can in the first hook on the second member;

grasping the handle; and lifting the carrying device.

2. The method of claim 1, further comprising:

placing the wire handle of a third can in the handle of the carrying device;

wherein the handle is hollow and open in the direction opposite of the first and second members.

3. The method of claim 2, further comprising:

Placing the wire handle of a fourth can in the handle of the carrying device;

Wherein the third and fourth cans are located on opposing sides of the handle.

* * * * *